US008496399B2

(12) United States Patent
Mittleman

(10) Patent No.: US 8,496,399 B2
(45) Date of Patent: Jul. 30, 2013

(54) LONGITUDINAL PAVEMENT JOINT AND APPARATUS FOR MAKING

(75) Inventor: Gary Mittleman, Loudonville, NY (US)

(73) Assignee: Advant-Edge Paving Equip, LLC, Loudonville, NY (US)

( * ) Notice: Subject to any disclaimer, the term of this patent is extended or adjusted under 35 U.S.C. 154(b) by 0 days.

(21) Appl. No.: 13/345,884

(22) Filed: Jan. 9, 2012

(65) Prior Publication Data

US 2012/0189387 A1 Jul. 26, 2012

Related U.S. Application Data

(60) Provisional application No. 61/434,743, filed on Jan. 20, 2011.

(51) Int. Cl.
*E01C 19/44* (2006.01)

(52) U.S. Cl.
USPC ..... 404/97; 404/118; 15/235.6

(58) Field of Classification Search
USPC ..... 15/235.4, 235.5, 235.6, 235.7; 404/96, 404/97, 98, 118
See application file for complete search history.

(56) References Cited

U.S. PATENT DOCUMENTS

| | | | | | |
|---|---|---|---|---|---|
| 78,381 | A * | 5/1868 | Leverty | ..... | 15/235.6 |
| 166,666 | A * | 8/1875 | Walter | ..... | 15/235.6 |
| 1,570,177 | A * | 1/1926 | Pointer | ..... | 451/495 |
| 3,915,583 | A * | 10/1975 | Aparicio | ..... | 404/98 |
| 4,181,449 | A | 1/1980 | Lenker | | |
| 5,819,485 | A * | 10/1998 | Lane et al. | ..... | 52/287.1 |
| 6,106,192 | A * | 8/2000 | Hargis et al. | ..... | 404/101 |
| 6,139,223 | A * | 10/2000 | Snyder | ..... | 405/179 |
| 6,238,134 | B1 | 5/2001 | Sovik | | |
| 6,238,136 | B1 | 5/2001 | Sovik et al. | | |
| 6,270,284 | B1 | 8/2001 | Sovik | | |
| 6,283,672 | B1 | 9/2001 | Sovik | | |
| 6,709,195 | B2 * | 3/2004 | Piccoli et al. | ..... | 404/98 |
| 6,729,088 | B2 * | 5/2004 | Corr | ..... | 52/290 |
| 6,923,594 | B2 | 8/2005 | Sovik et al. | | |
| 6,988,850 | B2 | 1/2006 | Sovik et al. | | |
| 7,172,364 | B1 * | 2/2007 | Nicholson | ..... | 404/96 |
| 7,246,402 | B2 * | 7/2007 | Washburn | ..... | 15/235.7 |
| 7,610,648 | B2 * | 11/2009 | Bongiovanni | ..... | 15/235.4 |
| 7,725,982 | B2 * | 6/2010 | Hoch | ..... | 15/235.7 |
| 2003/0192142 | A1 * | 10/2003 | Veith | ..... | 15/235.4 |

* cited by examiner

*Primary Examiner* — Gary Hartmann

(74) *Attorney, Agent, or Firm* — George Goodman

(57) ABSTRACT

A longitudinal pavement joint for joining pavement lanes, the longitudinal pavement joint comprising: one or more joining surfaces having respective slope angles between about 0 and about 45 degrees; and optionally, one or more wall surfaces having respective slope angles between about 45 and about 90 degrees, the joining surfaces and the wall surfaces being disposed adjacent one another, and one or more of the joining surfaces comprising a respective joining surface feature.

4 Claims, 4 Drawing Sheets

LONGITUDINAL PAVEMENT JOINT AND APPARATUS FOR MAKING

CROSS-REFERENCE TO RELATED APPLICATIONS

This application claims the benefit of provisional application No. 61/434,743, filed Jan. 20, 2011.

BACKGROUND

The present invention relates generally to the field of paving and more specifically to the longitudinal pavement joints occurring when roadways are paved in partial-width sections.

As used herein: "pavement" refers to any material—including, without limitation, asphalt concrete, Portland cement concrete, HMA, soil, or gravel—laid down over a pre-existing roadway; "roadway" refers to any surface on which a paving machine (paver) may be driven including, without limitation, streets, roads, highways, driveways, bicycle paths, jogging paths, runways, and unpaved road beds; "paving" refers to the process of laying down pavement.

In a wide variety of applications, pavement-shaping devices are used to produce a desired shape at an edge of a paved roadway. Often, the desired shape provides a ramp to allow vehicles to more easily and more safely regain the paved roadway after inadvertently driving off the edge.

In some instances, roadways are paved in partial-width sections, creating a temporary pavement edge which is eventually incorporated into a longitudinal pavement joint between adjacent partial-width sections of pavement. In these instances, the desired shape often provides additional features to promote effective sealing of the longitudinal pavement joint.

Opportunities exist, therefore, to provide an improved longitudinal pavement joint and a device for making that joint.

SUMMARY

The opportunities described above are addressed, in one aspect of the present invention, by a longitudinal pavement joint for joining pavement lanes, the longitudinal pavement joint comprising: one or more joining surfaces having respective slope angles between about 0 and about 45 degrees; and optionally, one or more wall surfaces having respective slope angles between about 45 and about 90 degrees, the joining surfaces and the wall surfaces being disposed adjacent one another, and one or more of the joining surfaces comprising a respective joining surface feature.

In another aspect of the present invention, an apparatus for making a longitudinal pavement joint comprises: one or more joining surface trowels having respective slope angles between about 0 and about 45 degrees; and optionally, one or more wall surface trowels having respective slope angles between about 45 and about 90 degrees, the joining surface trowels and the wall surface trowels being disposed and mechanically coupled adjacent one another, and one or more of the joining surface trowels comprising a respective joining surface feature trowel.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
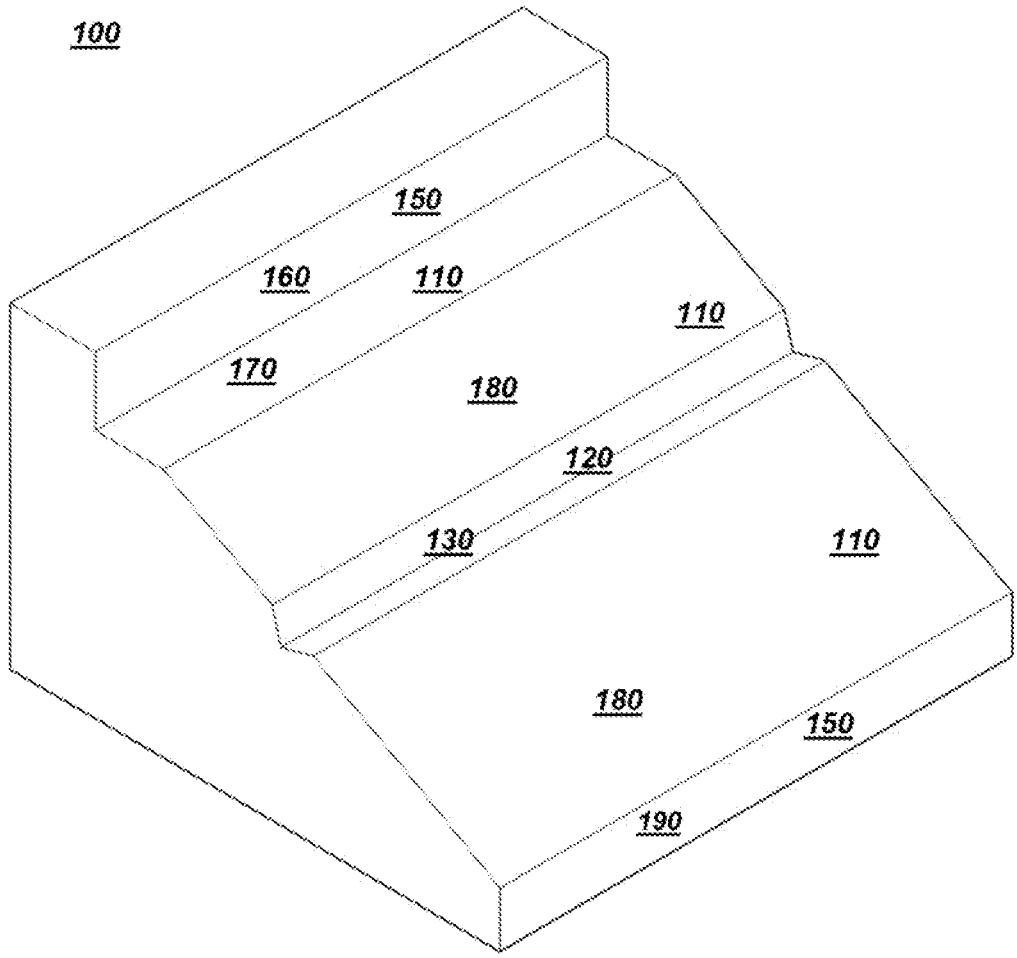
FIG. 1 illustrates a perspective drawing in accordance with one aspect and one embodiment of the present invention.

In accordance with one embodiment of the present invention, FIG. 1 illustrates a perspective drawing showing longitudinal pavement joint 100 for joining pavement lanes. Longitudinal pavement joint 100 comprises one or more joining surfaces 110 having respective slope angles between about 0 and about 45 degrees, and optionally, one or more wall surfaces 150 having respective slope angles between about 45 and about 90 degrees where all slope angles are reckoned from the horizontal. Joining surfaces 110 and wall surfaces 150 are disposed adjacent one another.

One or more of joining surfaces 110 comprises a respective joining surface feature 120. Joining surface feature 120 improves the effectiveness of longitudinal pavement joint 100 by increasing the joint surface area.

In a more specific embodiment in accordance with the embodiment of FIG. 1, longitudinal pavement joint 100 comprises a first wall surface 160 having a slope angle between about 45 and about 90 degrees, a first joining surface 170 having a slope angle between about 0 and about 45 degrees and being disposed adjacent first wall surface 160, a second joining surface 180 having a slope angle between about 0 and about 45 degrees and being disposed adjacent first joining surface 170, and a second wall surface 190 having a slope angle between about 45 and about 90 degrees and being disposed adjacent second joining surface 180. Second joining surface 180 comprises joining surface feature 120 shown as a pavement groove 130 with a triangular cross section.

Figure 2:
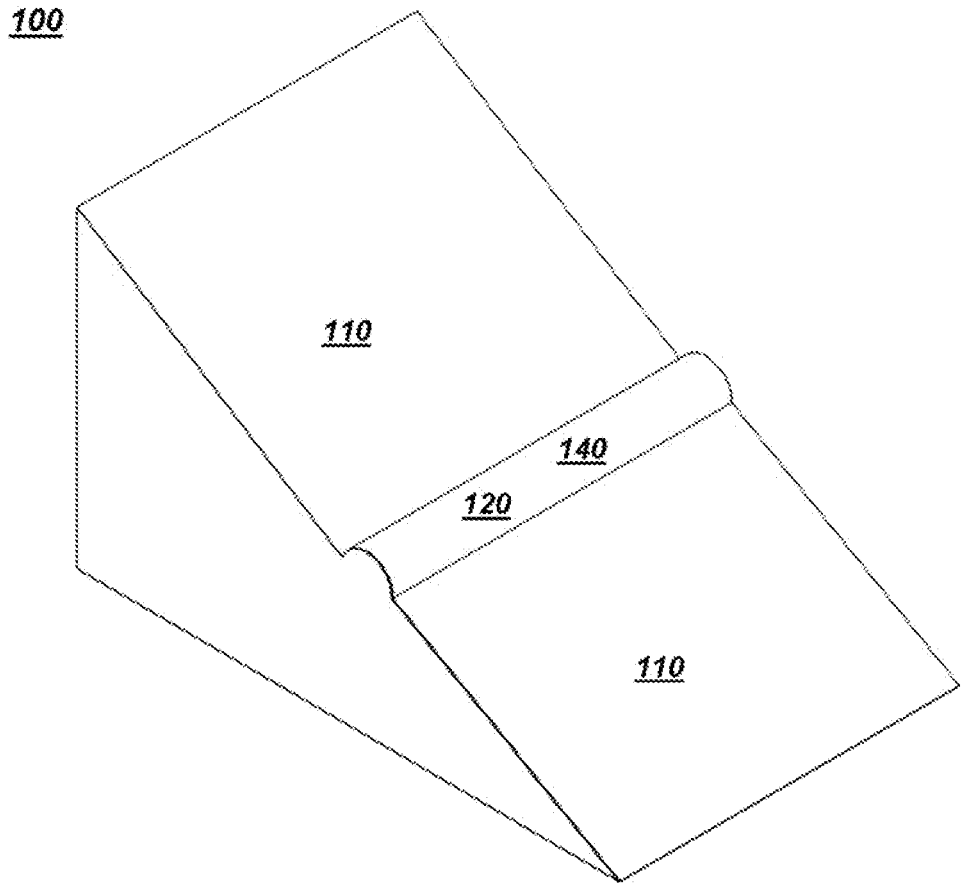
FIG. 2 illustrates a perspective drawing in accordance with an alternative embodiment of the embodiment of FIG. 1.

In accordance with an alternative embodiment of the embodiment of FIG. 1, FIG. 2 illustrates a perspective drawing showing longitudinal pavement joint 100 with no wall surfaces 150 and only a single joining surface 110. Joining surface 110 comprises joining surface feature 120 shown as a pavement bump 140 with a semicircular cross section.

Figure 3:
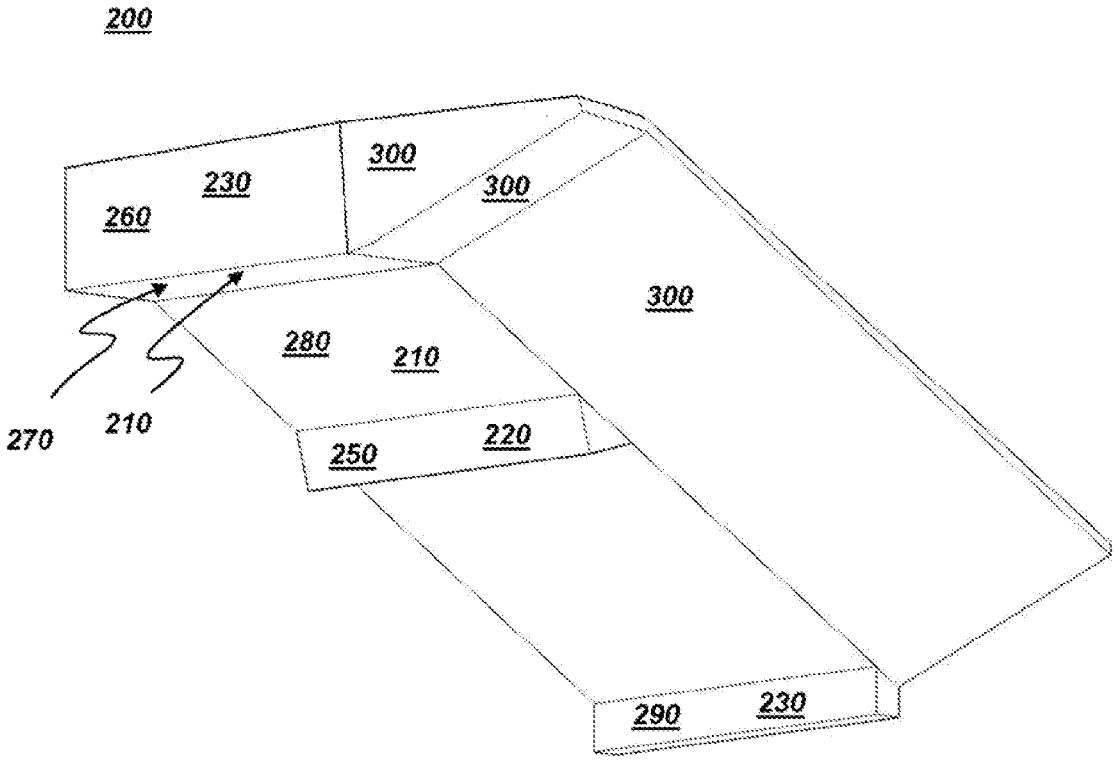
FIG. 3 illustrates a perspective drawing in accordance with another aspect and another embodiment of the present invention.

In accordance with another aspect and another embodiment of the present invention, FIG. 3 illustrates a perspective drawing of an apparatus 200 for making a longitudinal pavement joint 100. Apparatus 200 comprises one or more joining surface trowels 210 having respective slope angles between about 0 and about 45 degrees, and optionally, one or more wall surface trowels 230 having respective slope angles between about 45 and about 90 degrees where all slope angles are reckoned from the horizontal. Joining surface trowels 210 and wall surface trowels 230 are disposed and mechanically coupled adjacent one another. One or more of joining surface trowels 210 comprises a respective joining surface feature trowel 220. The trowels are configured for producing corresponding joining surfaces 110 and wall surfaces 150 as shown in FIG. 1.

In a more specific embodiment in accordance with the embodiment of FIG. 3, apparatus 200 comprises a first wall surface trowel 260 having a slope angle between about 45 and about 90 degrees, a first joining surface trowel 270 having a slope angle between about 0 and about 45 degrees and being disposed and mechanically coupled adjacent first wall surface trowel 260, a second joining surface trowel 280 having a slope angle between about 0 and about 45 degrees and being disposed and mechanically coupled adjacent first joining surface trowel 270, and a second wall surface trowel 290 having a slope angle between about 45 and about 90 degrees and being disposed and mechanically coupled adjacent second joining surface trowel 280. Second joining surface trowel 280 comprises a joining surface feature trowel 220 shown as an apparatus bump 250 with a triangular cross section.

In another more specific embodiment in accordance with the embodiment of FIG. 3, apparatus 200 further comprises one or more funneling trowels 300 disposed and mechanically coupled adjacent joining surface trowels 210 and wall surface trowels 230. Funneling trowels 300 guide unshaped pavement toward joining surface trowels 210 and wall surface trowels 230.

Figure 4:
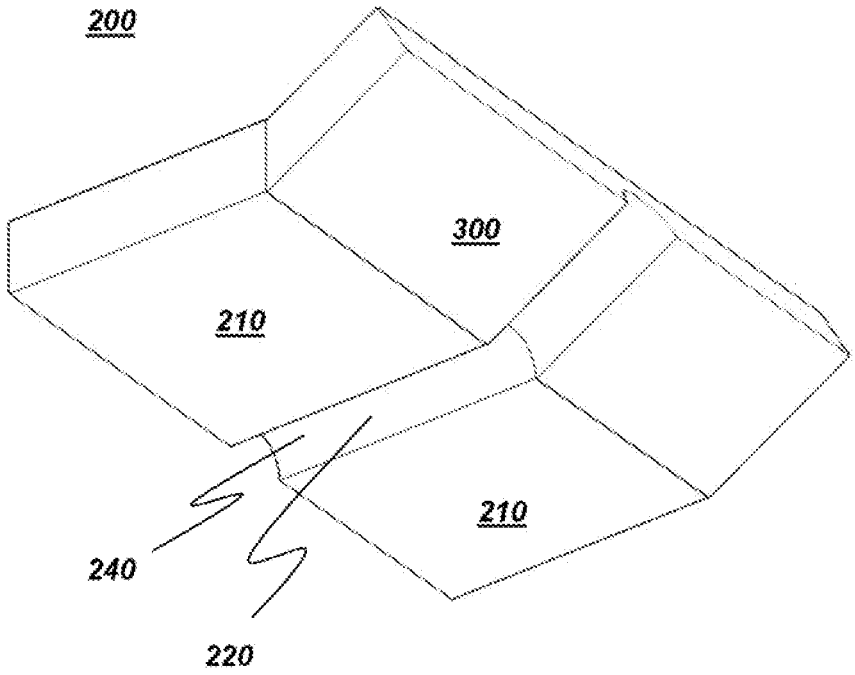
FIG. 4 illustrates a perspective drawing in accordance with an alternative embodiment of the embodiment of FIG. 3.

In accordance with an alternative embodiment of the embodiment of FIG. 3, FIG. 4 illustrates a perspective drawing showing apparatus 200 having no wall surface trowels 230 and only a single joining surface trowel 210. Joining surface trowel 210 comprises joining surface feature trowel 220 shown as an apparatus groove 240 with a semicircular cross section.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An apparatus for making a longitudinal pavement joint, said apparatus comprising:

a first wall surface trowel having a slope angle between about 45 and about 90 degrees;

a first joining surface trowel having a slope angle between about 0 and about 45 degrees and being disposed and mechanically coupled adjacent to, and non-coplanar with, said first wall surface trowel;

a second joining surface trowel having a slope angle between about 0 and about 45 degrees and being disposed and mechanically coupled adjacent to, and non-coplanar with, said first joining surface trowel; and a second wall surface trowel having a slope angle between about 45 and about 90 degrees and being disposed and mechanically coupled adjacent to, and non-coplanar with, said second joining surface trowel, said second joining surface trowel comprising a joining surface feature trowel.

2. The apparatus of claim 1 wherein said joining surface feature trowel comprises an apparatus groove or an apparatus bump.

3. The apparatus of claim 2 wherein said joining surface feature trowel has a polygonal or semicircular cross-section.

4. The apparatus of claim 1 further comprising one or more funneling trowels disposed and mechanically coupled adjacent said joining surface trowels and said wall surface trowels.

* * * * *